US010067447B2

(12) United States Patent
Umeda et al.

(10) Patent No.: US 10,067,447 B2
(45) Date of Patent: Sep. 4, 2018

(54) IMAGE HEATING DEVICE AND IMAGE FORMING APPARATUS HAVING REGULATION OF LUBRICANT

(71) Applicant: CANON KABUSHIKI KAISHA, Tokyo (JP)

(72) Inventors: Kensuke Umeda, Kawasaki (JP); Masashi Tanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/417,553

(22) Filed: Jan. 27, 2017

(65) Prior Publication Data

US 2017/0219969 A1 Aug. 3, 2017

(30) Foreign Application Priority Data

Feb. 1, 2016 (JP) ..... 2016-017446

(51) Int. Cl.
*G03G 15/20* (2006.01)

(52) U.S. Cl.
CPC ..... *G03G 15/2039* (2013.01); *G03G 15/2075* (2013.01)

(58) Field of Classification Search
CPC ..... G03G 15/2039; G03G 15/2075
USPC ..... 399/69
See application file for complete search history.

(56) References Cited

U.S. PATENT DOCUMENTS

| | | | | |
|---|---|---|---|---|
| 8,798,514 | B2 | 8/2014 | Tanaka et al. | |
| 9,291,958 | B2 | 3/2016 | Nakamoto et al. | |
| 9,423,729 | B2 * | 8/2016 | Matsuno ..... | G03G 15/2042 |
| 2014/0086648 | A1 * | 3/2014 | Maruyama ..... | G03G 15/2053 399/329 |
| 2017/0160684 | A1 * | 6/2017 | Zhang ..... | G03G 15/2053 |

FOREIGN PATENT DOCUMENTS

| | | | |
|---|---|---|---|
| JP | 0444075 | A | 2/1992 |
| JP | 0527619 | A | 2/1993 |
| JP | 2009053507 | A | 3/2009 |
| JP | 2015228017 | A | 12/2015 |

* cited by examiner

*Primary Examiner* — Billy Lactaoen
(74) *Attorney, Agent, or Firm* — Fitzpatrick, Cella, Harper & Scinto

(57) ABSTRACT

A first region of a guide surface of a guide member, being in contact with an inner surface of a film on an upstream side of a heater in a rotation direction of the film, has a higher percentage of the protrusions per unit length in a longitudinal direction of the guide member than a second region of the guide surface, and the first and second regions are a region of the guide surface that overlaps a temperature detecting member and a region of the guide surface that does not overlap the temperature detecting member, respectively, in the longitudinal direction of the guide member.

14 Claims, 8 Drawing Sheets

IMAGE HEATING DEVICE AND IMAGE FORMING APPARATUS HAVING REGULATION OF LUBRICANT

BACKGROUND OF THE INVENTION

Field of the Invention

The present invention relates to a so-called film heating-type image heating device configured to heat a developer image on a recording material and an image forming apparatus including the same.

Description of the Related Art

A conventional image heating device of this kind is for example known from Japanese Patent Application Laid-open No. 04-44075. More specifically, the known device includes a flexible film (tubular rotating member), a heating member provided slidably at an inner circumference of the film, a pressure roller (pressure member) that nips the film between the heating member and itself to form a pressure-contact nip portion. The pressure-contact nip portion nips and transports a recording material having a toner image formed thereon, and the toner image is fixed on the recording material by heat from the heating member and pressure force by the pressure-contact nip portion.

The temperature of the heating member is detected by a temperature detecting element provided at a surface of the heating member on the opposite side to the pressure-contact nip portion and controlled at a prescribed temperature.

In the meantime, Japanese Patent Application Laid-open No. 05-27619 suggests such a film-heating type image heating device in which a lubricant is interposed between a film and a heating member in order to secure slidability between the film and the heating member.

The lubricant is desirably applied uniformly on the inner surface of the film but it is a general practice in manufacturing to apply the lubricant on the surface of the heating member.

However, when the lubricant is applied on the heating member and rotation of the film is not sufficient, a large amount of the lubricant may be left sticking on the heating member during, for instance, shipment of the product. The presence of much lubricating grease between the heating member and the film prevents transmission of heat from the heating member to the film, and therefore the heating member can be easily heated to high temperatures.

As a result, when the temperature is controlled in response to a temperature detected at a surface of the heating member different from the sliding surface of the film, electric power provided to the heating member is reduced, and therefore the amount of heat generation is reduced. In this way, the amount of heat transmitted to the recording material is also reduced, so that toner may not be sufficiently melted, in other words, a heating failure may result. A reduction in the amount of the lubricant may reduce such a failure but then the friction between the film and the heating member increases, which may cause slipping between the film and the recording material.

SUMMARY OF THE INVENTION

A first aspect of the present invention is providing a fixing apparatus fixing a toner image on a recording material, the fixing apparatus comprising:

a tubular film;

an elongate heater having a first surface and a second surface which is a surface on an opposite side to the first surface, the first surface of the heater being in contact with an inner surface of the film;

a roller provided in contact with an outer surface of the film to form a nip portion between the film and the roller;

a lubricant interposed between the first surface of the heater and the inner surface of the film;

a temperature detecting member provided on the second surface of the heater to detect a temperature of the heater;

a controller controlling electric power to be supplied to the heater so that a temperature detected by the temperature detecting member reaches a target temperature; and a guide member elongated in a longitudinal direction of the heater and being in contact with the inner surface of the film on an upstream side of the heater in a rotation direction of the film, the guide member having a plurality of protrusions provided side by side in a longitudinal direction of the guide member at intervals at a guide surface opposed to the inner surface of the film and being in contact with the inner surface of the film, wherein the recording material having the toner image formed thereon is heated and has the image fixed thereon while being transported by the nip portion, and wherein a first region of the guide surface of the guide member has a higher percentage of the protrusions per unit length in the longitudinal direction of the guide member than a second region of the guide surface, and the first and second regions are a region of the guide surface that overlaps the temperature detecting member and a region of the guide surface that does not overlap the temperature detecting member, respectively, in the longitudinal direction of the guide member.

Further features of the present invention will become apparent from the following description of exemplary embodiments (with reference to the attached drawings).

DESCRIPTION OF THE EMBODIMENTS

Modes for carrying out the present invention are illustratively explained in detail below on the basis of embodiments with reference to the drawings. However, dimensions, materials, and shapes of components described in the embodiments, relative arrangement of the components, and the like should be changed as appropriate according to the configuration of an apparatus to which the invention is applied and various conditions. That is, the dimensions, the materials, the shapes, and the relative arrangement are not intended to limit the scope of the present invention to the embodiments.

First Embodiment

Figure 1A:
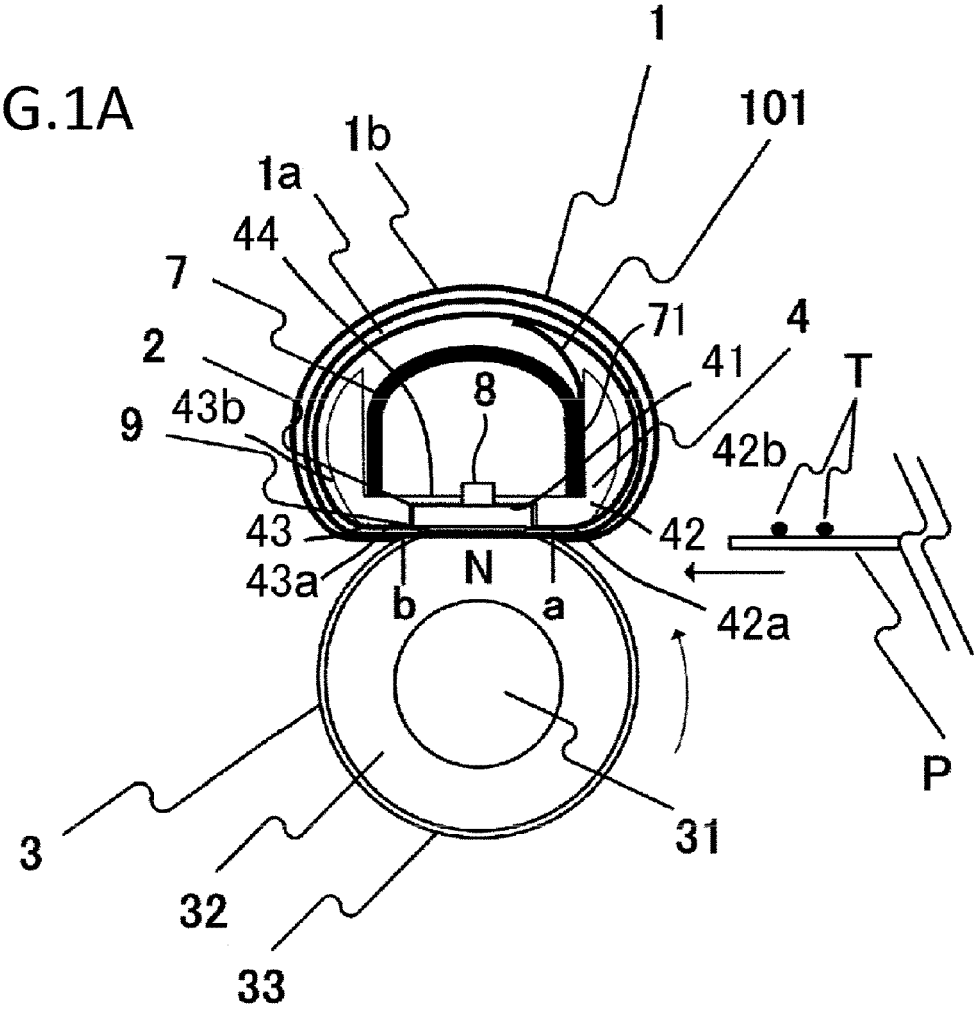
FIG. 1A is a sectional view of a fixing apparatus provided with a grease regulating sheet according to a first embodiment of the invention.
Figure 1B:
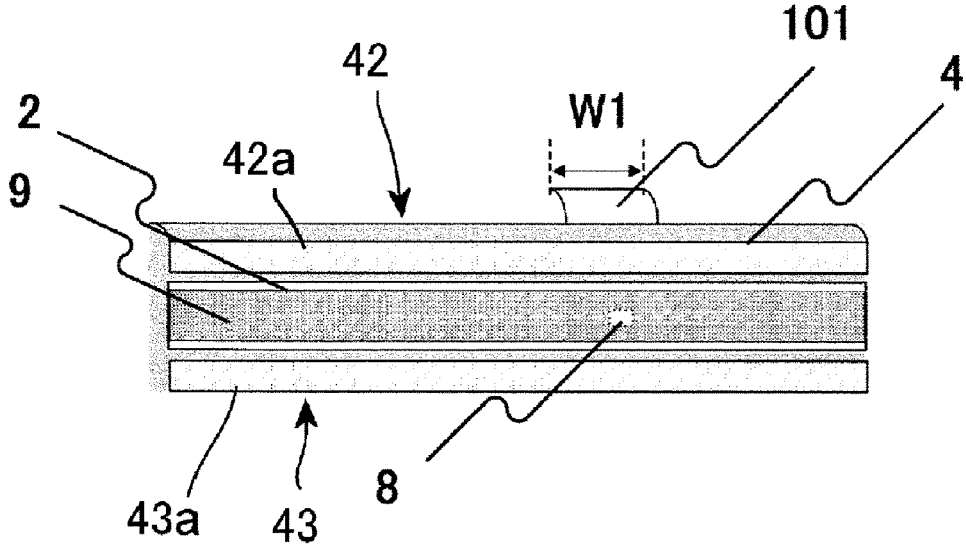
FIG. 1B is a bottom view of a heater holder in FIG. 1A.
Figure 2:
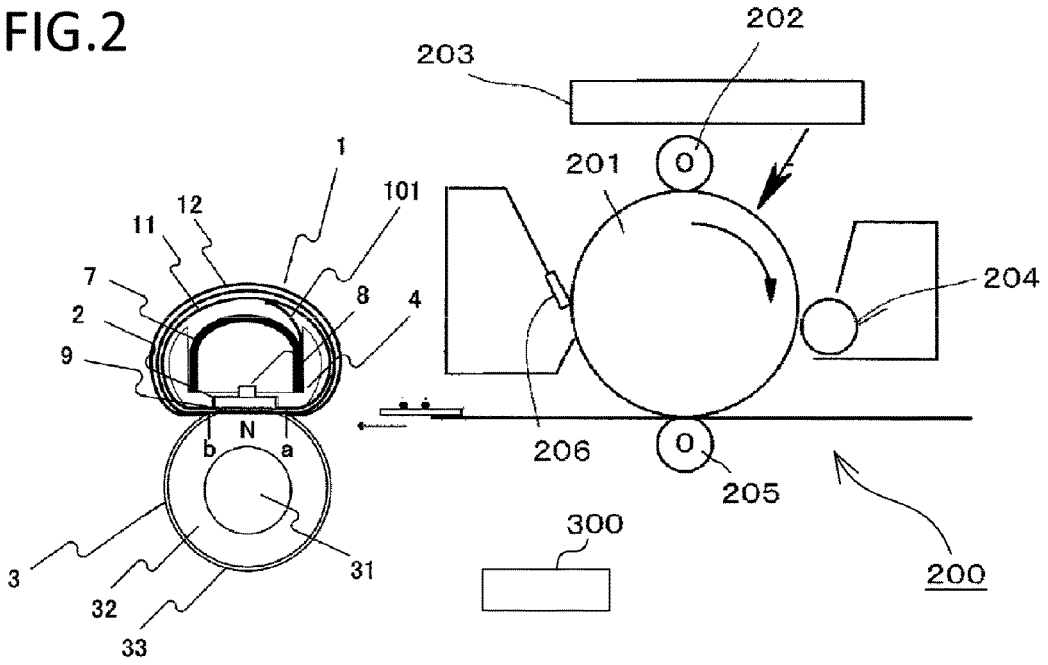
FIG. 2 is a view illustrating a concept of an image forming apparatus to which the fixing apparatus according to the first embodiment is applied.

FIGS. 1A and 1B illustrate a concept of an image heating device according to a first embodiment of the invention, and FIG. 2 illustrates a concept of an image forming apparatus including the image heating device.

As illustrated in FIG. 2, the image heating device is used as a fixing apparatus configured to heat and fix a toner image formed on a recording material P in an image forming portion 200.

More specifically, in the image forming portion 200, an image is exposed to light by an exposure device 203 and an electrostatic latent image is formed on a surface of a photoreceptor drum 201 evenly charged by a charging roller 202. The latent image is made visible as a toner image by a developing device 205, and the toner image is transferred onto the recording material P by a transfer roller 206.

Then, the recording material P bearing the toner image T thereon is sent into the image heating device by a transport means (not shown) and has the toner image T fixed thereon by heating.

Now, the image heating device will be described in detail with reference to FIG. 1.

The image heating device includes a flexible fixing film 1 as a tubular rotating member, a heater 2 as a heating member in sliding contact with an inner surface of the fixing film 1, and a pressure roller 3 abutted against the heater 2 through the fixing film 1 to form a pressure-contact nip portion N.

The heater 2 is held in a heater holder 4 as a holding member, and a temperature detecting element 8 such as a thermistor and the like is provided on a surface of the heater 2 on the opposite side to the pressure-contact nip portion N. The temperature detecting element 8 has a width of 1 mm.

The temperature detecting element 8 is adapted to contact the heater holder 4 and detect the temperature of the heater 2. The recording material P having a toner image formed thereon is nipped and transported by the pressure-contact nip portion N in a pressurized state and heated by the heater 2 having its temperature controlled by the controller 300 with the temperature detected by the temperature detecting element 8.

While the fixing film 1 is not under tension, the fixing film 1 is rotated by rotating of the pressure roller 3 in the direction indicated by the arrow in the figure. The contact surface of the fixing film with the heater 2 slides, and its contact surface with the pressure roller 3 does not slide but moves together with the pressure roller as the roller rotates. The heater holder 4 is provided on the inner side of the fixing film 1 to hold the heater 2 and has a guide portion in sliding contact with the fixing film 1. A pressure stay 7 adapted to press the heater holder 4 toward the pressure roller 3 is provided on the inner side of the fixing film 1.

Lubricating grease 9 is applied on the front surface side of the heater 2, in other words, on the side sliding against the fixing film 1 in order to secure slidability between the fixing film 1 and the heater 2. When the region between the sliding surfaces of the fixing film 1 and the heater 2 is the sliding portion, the lubricating grease 9 partly sticks to the inner peripheral surface of the fixing film 1, is then let out from the downstream end of the sliding portion and returns to the upstream side end of it in a circulation. A grease regulating means as a feature of the embodiment is provided in abutment against the inner surface of the fixing film 1.

The fixing film 1 has a two-layer structure including a base layer 1*a* and a front layer 1*b*. The base layer 1*a* represents mechanical characteristics such as the torsional strength or smoothness of the fixing film 1 and is made of a resin such as polyimide and the like or a metal or alloy such as SUS having high thermal conductivity. The front layer 1*b* is made of highly releasable PFA or PTFE, so that toner or paper dust for example is unlikely to stick thereto. An elastic layer of silicone rubber and the like may be provided between the base layer 1*a* and the front layer 1*b* in order to provide high followability to the recording material.

The fixing film 1 according to the embodiment has an outer diameter ϕ18 and a length of 230 mm in the longitudinal direction. The base layer 1*a* is made of polyimide having a thickness of 60 μm. The front layer 1*b* is provided with a PFA coating as a releasing layer having a thickness of 12 μm.

The heater 2 has an elongate heater substrate that extends in the direction of the rotating axis of the fixing film. Examples of the substrate may include an insulating ceramics substrate of alumina or aluminum nitride and the like and a heat-resisting resin substrate of polyimide, PPS, or liquid crystal polymer and the like. A conduction heat generation resistance layer for example of Ag/Pd (silver-palladium) is applied/formed for example by screen printing at a surface of the substrate linearly or in an elongate form in the lengthwise direction. In order to protect the conduction heat generation resistance layer and secure insulation, an insulation protection layer for example of glass or polyimide resin is provided at a surface of the substrate to cover the conduction heat generation resistance layer.

The temperature detecting element 8 such as a thermistor abuts against the back surface side of the heater substrate, and conduction of the conduction heat generation resistance layer is controlled by the controller 300 in response to a temperature detected by the temperature detecting element 8.

In the heater 2 according to the embodiment, alumina is used as the material of the substrate, the Ag/Pd conduction heat generation resistance layer is provided, and the insulation protection layer by glass-coating is provided. The resistance value of the conduction heat-generation resistance layer is 15Ω. The substrate has a width of 5.83 mm in the transport direction for the recording material, a length of 270 mm in the longitudinal direction, and a thickness of 1 mm. The temperature detecting element 8 is a thermistor, and energization is controlled by the controller 300 so that the temperature of the thermistor detected while paper passes therethrough is 220° C.

The pressure roller 3 includes a core metal 31 of a material such as iron, aluminum and the like, an elastic layer 32 of a material such as silicone rubber and the like, and a releasing layer 33 of a material such as PFA. The pressure roller 3 preferably has a hardness from 30° to 60° for a load of 600 gf using an ASKER durometer type C, so that a nip width and durability that can achieve satisfactory fixability are obtained.

According to the embodiment, the core metal 31 is aluminum core metal with ϕ11, the elastic layer 32 is made of sponge type rubber obtained by foaming silicone rubber and having a thickness of 3.5 mm for thermal insulation, and a conductive PFA tube having a thickness of 40 μm is provided as a coating thereon. The hardness is 45°, the outer diameter is ϕ18, and the length of the elastic layer in the longitudinal direction is 225 mm. As the fixing motor (not shown) rotates, the pressure roller 3 rotates.

The heater holder 4 is provided to maintain the position of the fixing film 1 and hold the heater 2 and so on, the fixing film 1 slides against the heater holder 4, and therefore a heatproof mold having high slidability such as liquid crystal polymer, PPS, PET and the like is preferably used.

The heater holder 4 is a long member having a trough-shaped section and includes a fitting depressed portion 41 (support) for supporting the heater 2 at a surface on the side of the pressure-contact nip portion N, an upstream guide portion 42 that guides rotation of the fixing film 1 in sliding contact with its inner circumference, and a downstream guide portion 43 as a guide portion on the downstream side on the upstream and downstream sides of the heater 2, respectively. The upstream guide portion 42 and the downstream guide portion 43 have flat surfaces 42*a* and 43*a* positioned adjacent to the heater 2 and flush with the surface of the heater 2 and curved surfaces 42*b* and 43*b* upright from the flat surfaces 42*a* and 43*a*. The heater holder 4 has its longitudinal ends engaged with the pressure stay 7 held at the frame of the device.

The pressure stay 7 is a long member having a U-sectional shape and has its open side faced downward and fitted into the fitting depressed portion 44 on the side of the heater holder 4 opposite to the pressure-contact nip portion N. The longitudinal ends of the pressure stay 7 are pressurized by a pressure spring (not shown) as a pressurizing means, and the heater holder 4 is pressurized against the pressure roller 3 through the heater 2 and the fixing film 1.

The pressure stay 7 is made of a rigid material such as iron, stainless steel, and a ZINEKOTE™ steel sheet so that pressure force received at its longitudinal ends is uniformly transmitted in the longitudinal direction of the heater holder 4, and the U-sectional shape increases the rigidity. In this way, while the flexion of the heater holder 4 is reduced, the pressure-contact nip portion N (the a-b region) having a prescribed width equal in the longitudinal direction of the pressure roller 3 is formed.

According to the embodiment, liquid crystal polymer is used as the material of the heater holder 4, and the ZINKOTE™ steel sheet is used as the material of the pressure stay 7. The pressure force applied on the pressure roller 3 is 13.5 kgf, and the pressure-contact nip portion N has a width (the a-b distance) of 7 mm at the time.

The lubricating grease 9 is heat-resistant fluorine-based grease and applied on the surface of the heater 2 in order to reduce the slidability between the fixing film 1 and the heater 2 and the heater holder 4. The lubricating grease 9 is spread on the inner surface of the fixing film 1 as the fixing film 1 rotates and serves to secure the slidability for the fixing film 1. The amount of the grease is preferably from 100 mg to 800 mg in order to secure the slidability over the life of the product.

According to the embodiment, the product life is equivalent to passing of 50000 paper sheets, and fluorine-based grease containing PFPE as base oil and PTFE as a thickening agent is used. 350 mg of the grease is applied on the surface of the heater 2 in a region having a length of 210 mm and a width of 5 mm.

Grease Regulating Sheet 101 (Portion for regulating lubricant)

According to the first embodiment, a grease regulating sheet 101 has a portion for regulating lubricant for locally regulating the amount of the lubricating grease 9 that sticks to the inner circumferential surface of the fixing film 1 and returns to the position of the sliding portion corresponding to the position of the temperature detecting element 8. The grease regulating sheet 101 regulates the amount returning to the position corresponding to the position of the temperature detecting element 8 to be locally less than the amount of the lubricant returning to the other position in the direction of the rotation axis of the fixing film 1 (in the longitudinal direction).

The grease regulating sheet 101 is a regulating member of a different member from that of the heater holder 4 and has one end fixed to the heater holder 4 and the other end abutted against the inner surface of the fixing film 1. In the illustrated example, the fixed end of the grease regulating sheet 101 is held and fixed between the upstream guide portion 42 of the heater holder 4 and one leg 71 of the pressure stay 7, while the free end extends toward the upstream side in the rotation direction to the inner circumferential surface of the fixing film 1 and has its tip end in contact with the surface in a direction opposed to the rotation direction. The contact pressure is maintained by elastic restoring force according to the deflection of the grease regulating sheet 101.

The grease regulating sheet 101 scrapes off the lubricating grease 9 sticking to the inner surface of the fixing film 1. The grease regulating sheet 101 is provided to cover the position of the temperature detecting element 8 with respect to the longitudinal direction of the heater holder 4. The grease regulating sheet 101 is provided so that the center part of the grease regulating sheet 101 corresponds to the position of the temperature detecting element 8 in the longitudinal direction of the heater holder 4.

Figure 6A:
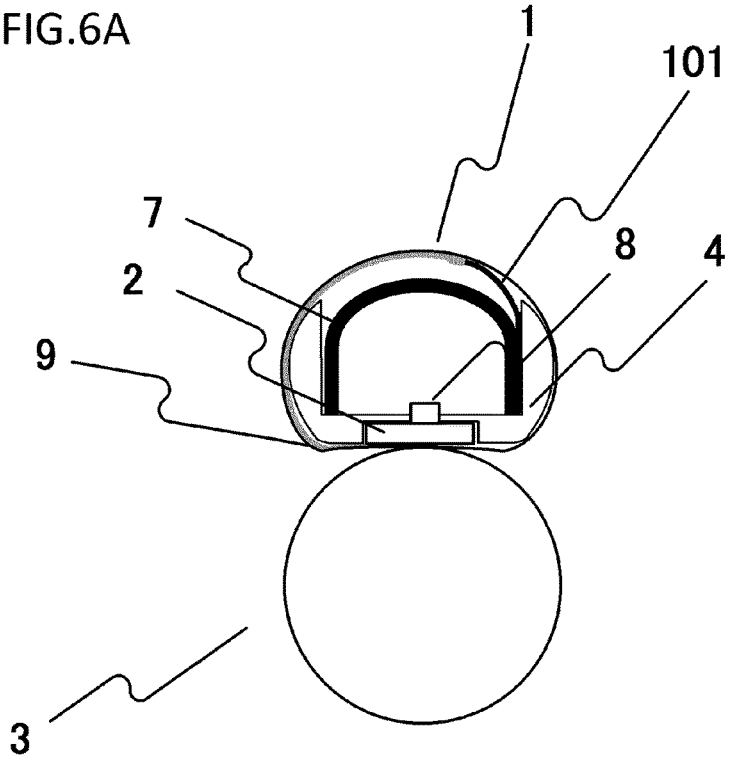
FIG. 6A is a view illustrating a concept of grease circulation in a section of a temperature detecting element in the fixing apparatus according to the first embodiment.
Figure 6B:
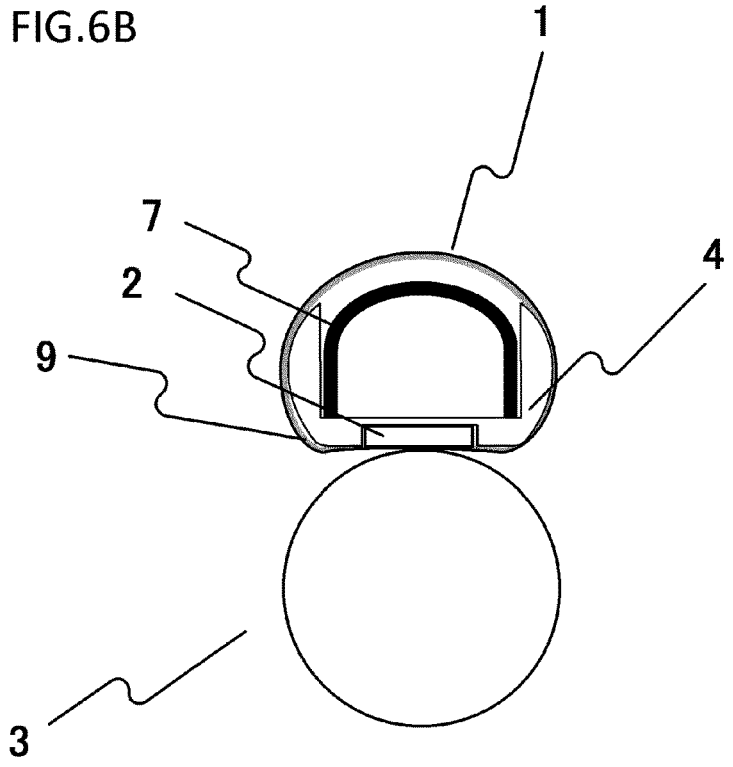
FIG. 6B is a view illustrating a concept of grease circulation in a section taken in another position.

The material of the grease regulating sheet 101 is a resin sheet material such as polyimide and the like having a prescribed thickness. The grease regulating sheet 101 preferably has a thickness of about 0.5 mm and a longitudinal regulating width of about 5 mm to 80 mm. If the regulating width is less than 5 mm, good lubricity results but the fixability is lowered. If the width is more than 80 mm, good fixability results but slipping is more likely because the amount of the lubricating grease is reduced. When the lubricating grease 9 sticking to the inner surface of the fixing film 1 is again nipped by the nip portion N, the lubricating grease 9 is spread, and therefore the distance between the end of the grease regulating sheet 101 and the end of the temperature detecting element 8 must be about 2 mm in order to reduce the effect of the lubricating grease 9 on the temperature detecting element 8. Since the temperature detecting element 8 according to the embodiment has a width of 1 mm, the longitudinal regulating width must be at least about 5 mm. If the width is too long, the amount of the lubricating grease is reduced, which increases the possibility of slipping, and therefore the width is preferably about 80 mm or less. FIG. 6 illustrates the state of the lubricating grease 9 when the fixing film 1 rotates. FIG. 6A illustrates a section of the fixing apparatus taken at the temperature detecting element 8, where the lubricating grease 9 sticking to the inner surface of the fixing film 1 is scraped off by the grease regulating sheet 101, and therefore the amount of grease returning to the heater 2 is reduced. FIG. 6B illustrates a section of the part excluding the temperature detecting element 8, where the lubricating grease 9 sticks to the inner surface of the fixing film 1 and returns to the heater 2 because the grease regulating sheet 101 is not provided.

Function and Effect of First Embodiment

The lubricating grease 9 on the surface of the heater 2 is made to stick to the inner surface of the fixing film 1 as the fixing film 1 rotates. However, the amount of the lubricating grease 9 that can stick to the inner surface of the fixing film 1 by the rotation is small, and therefore a large part of the grease remains on the surface of the heater 2. In the position of the temperature detecting element 8, the lubricating grease 9 sticking to the inner surface of the fixing film 1 is scraped off by the grease regulating sheet 101, so that when the fixing film 1 makes a rotation, the lubricating grease 9 on the surface of the heater 2 can again stick to the film.

Since the grease sticks to the fixing film 1 every time the fixing film 1 makes a rotation, the lubricating grease 9 in the position of the temperature detecting element 8 is reduced as compared to the other part. When the amount of the lubricating grease 9 on the surface of the heater 2 is small, heat from the heater 2 is transmitted to the fixing film, so that electric power can be more easily provided to the heater 2. In this way, fixing failures can be reduced.

Since the amount of the lubricant returning to the sliding portion is regulated, the amount of the lubricant remaining at the sliding portion against the heating member can be reduced, and the temperature of the heating member is less likely to rise to high temperature. In this way, fixing failures can be reduced without reducing electric power.

In particular, when the amount of the returning lubricant in the position of the temperature detecting element is locally reduced as compared to the other position, the amount of the lubricant in the part corresponding to the position of the temperature detecting element can be locally reduced, so that fixing failures can be reduced while maintaining the slidability.

As described above, when the lubricating grease 9 is on the surface of the heater 2 for example immediately after assembling, the lubricating grease 9 in the position of the temperature detecting element 8 is regulated, so that fixing failures can be reduced without any negative effect.

According to the embodiment, the sheet shaped resin is used as the portion for regulating lubricant, but the material is not limited to the same and any heat resistant material capable of scraping off the lubricating grease 9 on the inner surface of the fixing film 1 such as sponge, unwoven fabric and the like can be used instead of the above, and still the same effect can be provided.

Evaluation Tests

Now, the grease regulating sheet 101 according to the first embodiment was subjected to evaluation tests about the fixability immediately after assembling and slipping after having endured passing of paper sheets for different regulating widths W.

In the evaluation tests, five kinds of test examples of the grease regulating sheet 101 according to the first embodiment with different regulation widths and two kinds of comparative examples were prepared. In the test examples, there were five different regulating widths, i.e., 3 mm (test example 1), 5 mm (test example 2), 10 mm (test example 3), 80 mm (test example 4), and 150 mm (test example 5). In the comparative examples, comparative example 1 was not provided with the grease regulating sheet 101, and comparative example 2 was not provided with the grease regulating sheet 101 and the amount of the lubricating grease 9 applied was 50 mg.

The fixability was evaluated, in an L/L environment (at a temperature of 15° C. and with a humidity of 10%), by providing a voltage of 120 V to the heater 2 and transporting 100 letter size regular paper sheets (with a basis weight of 75 g/m$^2$) at 170 mm/sec.

As for the fixability, O represents the case in which a resulting toner image had no peeled part, and X represents the case in which a sheet or more had a peeled part. Integral electric energy provided to the heater 2 after the 100 sheets were passed therethrough was also measured. The slipping evaluation was carried out to check degradation in the slidability of the fixing film 1 by the grease regulating sheet 101. The evaluation was carried out, in the fixing apparatus after having passed 50000 sheets of paper and in an H/H environment (at a temperature of 30° C. and with a humidity of 80%), by transporting ten letter size regular paper sheets (with a basis weight of 75 g/m$^2$) at 170 mm/sec. As for the slipping, O represents the case in which the ten sheets were successfully passed therethrough, and X represents the case in which a jam occurred. The evaluation result is given in Table 1.

TABLE 1

| | Grease regulating width | Integral electric energy after passing 100 sheets | Fixability | Slipping |
|---|---|---|---|---|
| Test example 1 | 3 mm | 24.3 Wh | x | ○ |
| Test example 2 | 5 mm | 25.5 Wh | ○ | ○ |
| Test example 3 | 10 mm | 25.7 Wh | ○ | ○ |
| Test example 4 | 80 mm | 26.0 Wh | ○ | ○ |
| Test example 5 | 150 mm | 26.5 Wh | ○ | x |
| Comparative example 1 | No regulation | 24.0 Wh | x | ○ |
| Comparative example 2 | No regulation (50 mg of grease) | 25.5 Wh | ○ | x |

As in Table 1, in comparative example 1, the slipping evaluation was O but the fixability was not good because the integral electric energy provided to the heater 2 was small. The fixability was not good because the amount of the lubricating grease 9 was excess and the temperature detected by the temperature detecting element 8 did not reflect the actual temperature of the pressure-contact nip portion.

In comparative example 2, the amount of the lubricating grease 9 was reduced, and therefore the fixability was evaluated OK (O), but the slipping evaluation was not good (X). The slipping evaluation was not good because the amount of the lubricating grease 9 applied was so small that the inner surface of the fixing film 1 was out of the lubricating grease after passing of the sheets and the slidability of the fixing film 1 was lowered.

In contrast, in all the test examples according to the present invention, the lubricating grease 9 in the position of the temperature detecting element 8 was regulated, so that the amount of integral electric energy was larger than that in comparative example 1 with no such regulation.

Note however that in test example 1 with a sheet width of 3 mm, the slipping evaluation was OK while the fixability was not good. The lubricating grease 9 came around from the periphery of the grease regulating sheet 101 because the grease regulating sheet 101 had a narrow width, and the lubricating grease 9 could not be regulated sufficiently.

In test examples 2 to 4 in which the sheet width was 5 mm, 10 mm, and 80 mm, respectively, the integral electric energy increased and the fixability evaluation was OK. The slipping that could be a negative effect in association with regulation of the lubricating grease 9 was evaluated OK. This is because the lubricating grease 9 was regulated only in the periphery of the position of the temperature detecting element 8, and therefore the effect upon the slidability of the fixing film 1 was small. In test example 5 with a sheet width of 150 mm, the fixability was evaluated OK but the slipping evaluation was not good. This is because the grease regulating sheet 101 had a large width and therefore the area for scraping off the lubricating grease 9 at the inner surface of the fixing film 1 was large, which lowered the slidability of the fixing film 1.

In the evaluation tests described above, when the width of the grease regulating sheet 101 was from 5 mm to 80 mm, the fixability and slipping evaluation were satisfactory. However, the optimum range for the width of the grease regulating sheet 101 varies depending on the fixation configuration, and the fixability of a toner image and the slidability of the fixing film 1 must be secured accordingly.

Now, other embodiments of the present invention will be described.

The following embodiments will be described mainly in connection with differences from the first embodiment, and the same components will be designated by the same reference characters and their description will not be repeated.

Second Embodiment

Figure 3A:
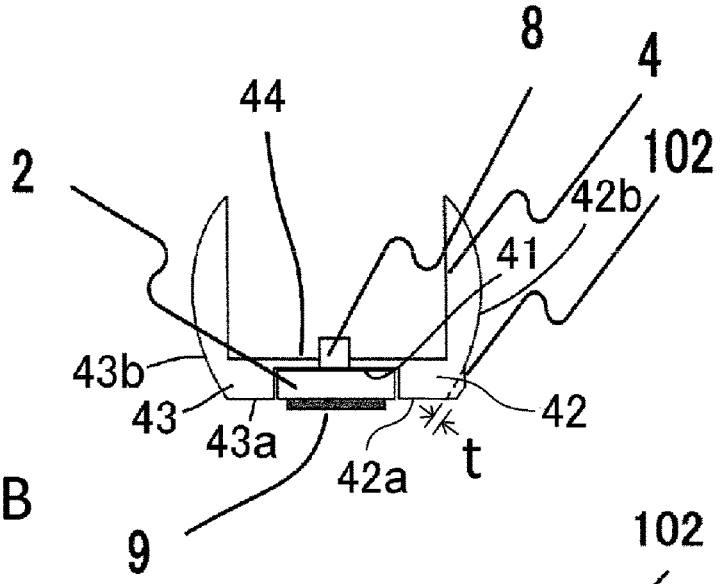
FIG. 3A is a sectional view of a fixing apparatus provided with a grease regulating protrusion according to a second embodiment of the invention.
Figure 3B:
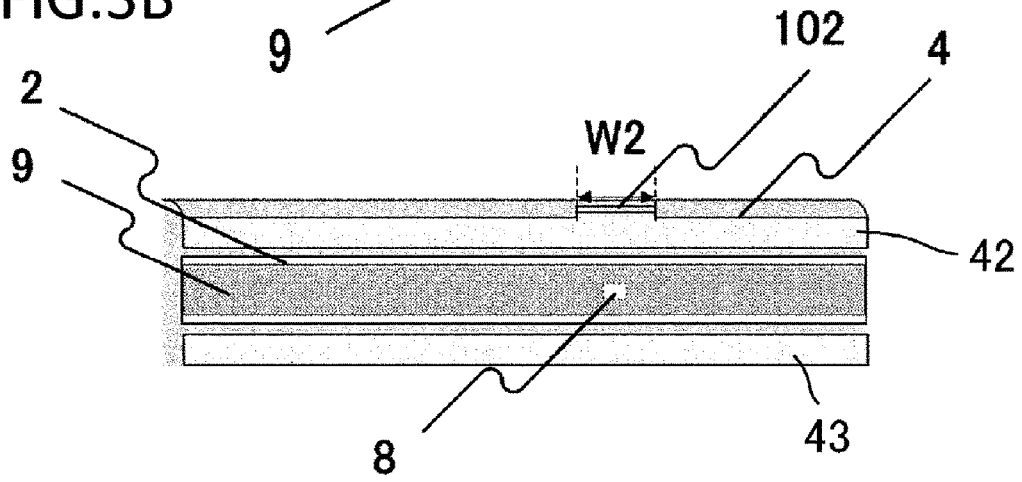
FIG. 3B is a bottom view of FIG. 3A.

FIG. 3 illustrates an essential part of a fixing apparatus according to a second embodiment of the invention.

According to the second embodiment, a protrusion for regulating grease 102 as a portion for regulating lubricant adapted to regulate the returning of lubricant sticking to the inner circumferential surface of the fixing film 1 to the sliding portion is provided at an upstream guide portion 42 serving as a guide for a heater holder (guide member) 4. More specifically, the protrusion for regulating grease 102 regulates, with its form, the amount of lubricant so that the amount returning to the position of the sliding portion corresponding to the position of the temperature detecting element 8 is locally less than the amount of the lubricant returning to the other position in the direction of the rotational axis of the fixing film 1. The protrusion for regulating grease 102 forms the regulating portion according to the embodiment.

The protrusion for regulating grease 102 is provided to extend around the position of the upstream guide portion 42 corresponding to the position of the temperature detecting element 8 for a prescribed width in the longitudinal direction and rub hard against the inner surface of the fixing film 1. The length of the protrusion for regulating grease 102 in the longitudinal direction corresponds to the regulating width W for regulating the lubricating grease 9, so that the returning of the lubricating grease to the sliding portion is thus regulated. In the illustrated example, the protrusion is provided at the lower end of the curved surface 42*b* transitioning to the flat surface 42*a* of the upstream guide portion 42 opposed to the inner surface of the fixing film 1.

The protrusion for regulating grease 102 protrudes for a prescribed height t with respect to the outer peripheral surface of the heater holder 4. The protrusion height t is preferably about 0.2 mm. The regulating width W2 of the protrusion for regulating grease 102 in the longitudinal direction is preferably from 5 mm to 100 mm. If the width is smaller than 5 mm, good lubricity results but the fixability is lowered. If the width is more than 100 mm, good fixability results but slipping is more likely because the amount of the lubricating grease is small.

Figure 7A:
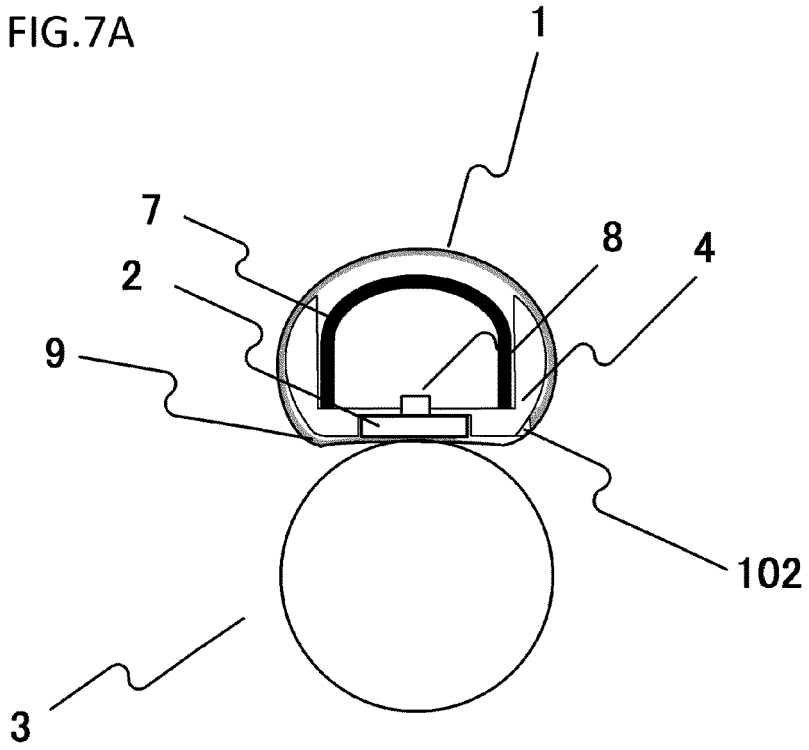
FIG. 7A is a view illustrating a concept of grease circulation in a section of a temperature detecting element in the fixing apparatus according to the second embodiment.
Figure 7B:
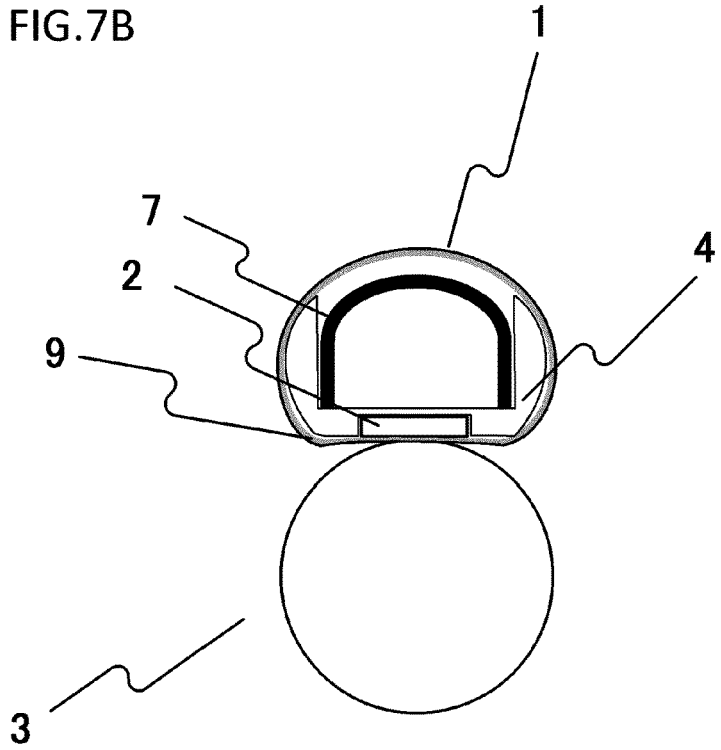
FIG. 7B is a view illustrating a concept of grease circulation in a section taken in another position.

FIG. 7 illustrates the state of the lubricating grease 9 when the fixing film 1 rotates. FIG. 7A illustrates a section of the fixing apparatus taken at the temperature detecting element 8, in which the lubricating grease 9 sticking to the inner surface of the fixing film 1 is scraped off by the protrusion for regulating grease 102, so that the returning amount to the heater 2 is reduced. FIG. 7B illustrates a section taken at the position other than the position of the temperature detecting element 8, in which the lubricating grease 9 sticks to the inner surface of the fixing film 1 and returns to the heater 2 because the protrusion for regulating grease 102 is not provided.

Function of Second Embodiment

The lubricating grease 9 on the surface of the heater 2 sticks to the inner surface of the fixing film 1 as the fixing film 1 rotates, is let out from the downstream end of the sliding surface of the heater 2, and returns to the sliding surface of the heater 2 from the upstream end of the heater 2 as the fixing film 1 further rotates.

According to the second embodiment, when the fixing film 1 makes a rotation, the protrusion for regulating grease 102 provided at the upstream guide portion 42 of the heater holder 4 and the inner surface of the fixing film 1 rub hard against each other, and therefore the lubricating grease 9 at the inner surface of the fixing film 1 is scraped off. In this way, the returning of the lubricating grease to the heater 2 is regulated, and the lubricating grease 9 in the position corresponding to the position of the temperature detecting element 8 is reduced as compared to the other position. Since the amount of the lubricating grease 9 on the sliding surface of the heater 2 is small, heat from the heater 2 is transmitted to the fixing film 1, so that the heater 2 can be more easily provided with electric power. In this way, fixing failures can be reduced.

Evaluation Tests

Now, the protrusion for regulating grease 102 according to the second embodiment was subjected to evaluation tests about the fixability immediately after assembling and slipping after having endured passing of paper sheets for different regulating widths W similarly to the first embodiment.

In the evaluation tests, five kinds of test examples of the protrusion for regulating grease 102 according to the second embodiment and two kinds of comparative examples with no regulating means were prepared similarly to the first embodiment. In the test examples, there were five regulating widths, i.e., 3 mm (test example 6), 5 mm (test example 7), 10 mm (test example 8), 100 mm (test example 9), and 150 mm (test example 10).

In the evaluation tests, similarly to the first embodiment, comparative example 1 was not provided with the protrusion for regulating grease 102, and the grease regulating widths of the test examples of the protrusion for regulating grease 102 were 3 mm (test example 6), 5 mm (test example 7), 10 mm (test example 8), 100 mm (test example 9), and 150 mm (test example 10).

The fixability and slipping evaluation after having endured passing of paper sheets were evaluated by the same method as that according to the first embodiment. The results are shown in Table 2.

TABLE 2

| | Grease regulating width | Integral electric energy after passing 100 sheets | Fixability | Slipping |
|---|---|---|---|---|
| Test example 6 | 3 mm | 24.3 Wh | x | ○ |
| Test example 7 | 5 mm | 25.0 Wh | ○ | ○ |
| Test example 8 | 10 mm | 25.3 Wh | ○ | ○ |
| Test example 9 | 100 mm | 25.6 Wh | ○ | ○ |
| Test example 10 | 150 mm | 26.0 Wh | ○ | x |
| Comparative example 1 | No regulation | 24.0 Wh | x | ○ |

As can be understood from Table 2, in the test examples of the second embodiment, the lubricating grease 9 in the position of the temperature detecting element 8 was regulated, therefore the integral electric energy was larger than that in comparative example 1 with no such regulation.

In test example 6, the slipping was evaluated OK but the fixability was not good. This is because the width of the protrusion for regulating grease 102 was so small that the lubricating grease 9 came around from the periphery of the protrusion for regulating grease 102 and could not be sufficiently regulated.

In test examples 7 to 9, both the fixability and the slipping were evaluated OK.

As compared to comparative example 1, according to the second embodiment, the lubricating grease 9 in the position of the temperature detecting element 8 was regulated by the protrusion for regulating grease 102, so that the integral electric energy was large and the fixability was OK. The slipping as a negative effect by regulating the lubricating grease 9 was also evaluated OK. This is because the lubricating grease 9 was regulated only in the periphery of the position of the temperature detecting element 8, and therefore the effect on the slidability of the fixing film 1 was small.

In test example 10, the fixability was OK but the slipping was not good.

This is because the protrusion for regulating grease 102 having the larger width scraped off the lubricating grease 9 in a larger area on the inner surface of the fixing film 1, so that the slidability of the fixing film 1 was lowered.

In the configuration according to the second embodiment, the fixability and slipping evaluation were satisfactory when the width of the protrusion for regulating grease 102 was from 5 mm to 100 mm.

However, the optimum value for the width of the protrusion for regulating grease 102 varies depending on the fixation configuration, the range from 5 mm to 100 mm does not always provide a satisfactory result, and the lubricating grease 9 in the position of the temperature detecting element 8 must be regulated, so that the slidability for the fixing film 1 must be secured.

As described above, even when a large amount of the lubricating grease 9 is on the surface of the heater 2 for example immediately after assembling, the protrusion for regulating grease 102 is provided upstream of the heater holder 4 to regulate the lubricating grease 9 in the position of the temperature detecting element 8, so that fixing failures can be reduced.

Note that according to the second embodiment, the protrusion for regulating grease 102 is provided at the upstream guide portion 42 of the heater holder 4 but the protrusion may be provided at the downstream guide portion 43. The protrusion for regulating grease provided at the downstream guide portion 43 can regulate the returning of the lubricating grease 9 sticking to the inner circumferential surface of the fixing film 1 to the position of the sliding surface of the heater 2 corresponding to the temperature detecting element 8, and therefore the same effect can be provided. In addition, the protrusion for regulating grease 102 may be provided both at the upstream guide portion 42 and the downstream guide portion 43, in other words, on at least one of the upstream side and downstream side of the heater 2.

Third Embodiment

Figure 4A:
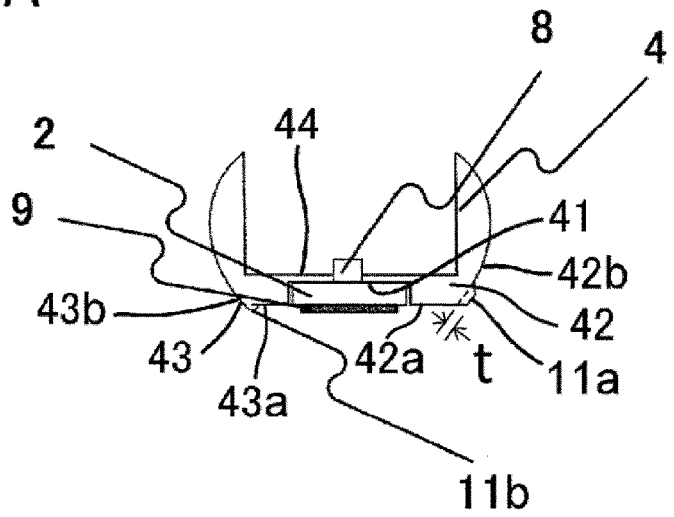
FIG. 4A is a sectional view of a fixing apparatus provided with grease regulating ribs according to a third embodiment of the invention.
Figure 4B:
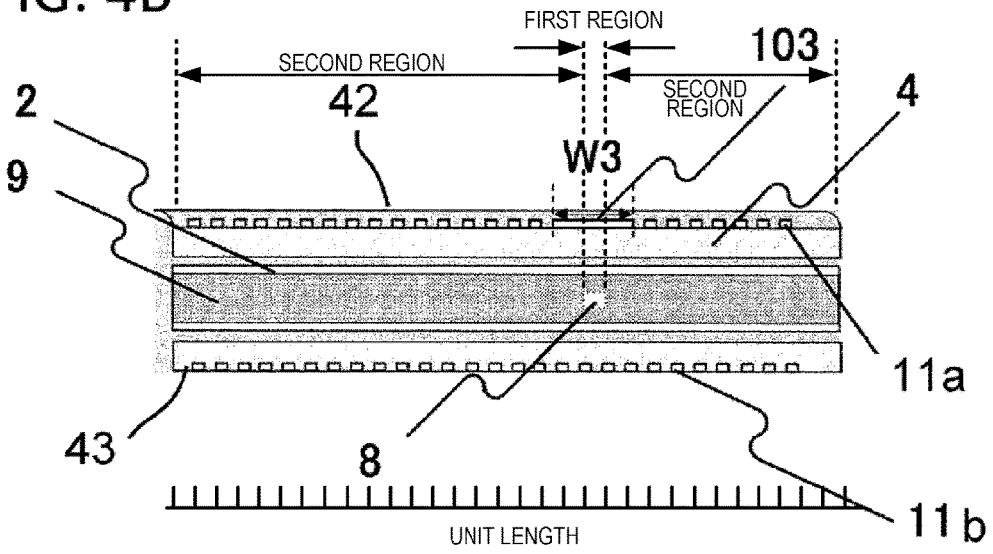
FIG. 4B is a bottom view of FIG. 4A.

FIG. 4 illustrates a main part of a fixing apparatus according to a third embodiment of the present invention.

According to the third embodiment, the product life is equivalent to passing of 100000 paper sheets. Therefore, as illustrated in FIG. 4, the upstream guide portion 42 and the downstream guide portion 43 positioned upstream and downstream of the heater holder 4 are provided with upstream ribs 11*a* and downstream ribs 11*b* as lubricating ribs (protrusions) extending in the rotation direction of the fixing film 1 at prescribed intervals in the direction of rotation axis. The length of the upstream and downstream ribs 11*a* and 11*b* in the rotation direction is short and about equal to the thickness of the heater 2. The presence of the upstream and downstream ribs 11*a* and 11*b* reduces the contact area between the fixing film 1 and the heater holder 4 and facilitates the circulation of the lubricating grease 9 between the upstream ribs 11*a* and downstream ribs 11*b*, which improves the slidability. In this way, the slidability is secured through the product life.

The upstream ribs 11*a* are provided at the lower end of a curved surface 42*b* transitioning to the flat surface 42*a* of the upstream guide portion 42, and the downstream ribs 11*b* are provided at the downstream end of the flat surface 43*a* transitioning to the curved surface of the downstream guide portion 43.

The protrusion height t of the upstream ribs 11*a* and the downstream ribs 11*b* from the guide surface of the heater holder 4 is 0.2 mm, the width of the heater holder 4 in the longitudinal direction is 1 mm, and the ribs are provided at intervals of 1 mm in the longitudinal direction. The length of the upstream ribs 11*a* and the downstream ribs 11*b* in the rotation direction of the fixing film 1 is about 1 mm.

Figure 8:
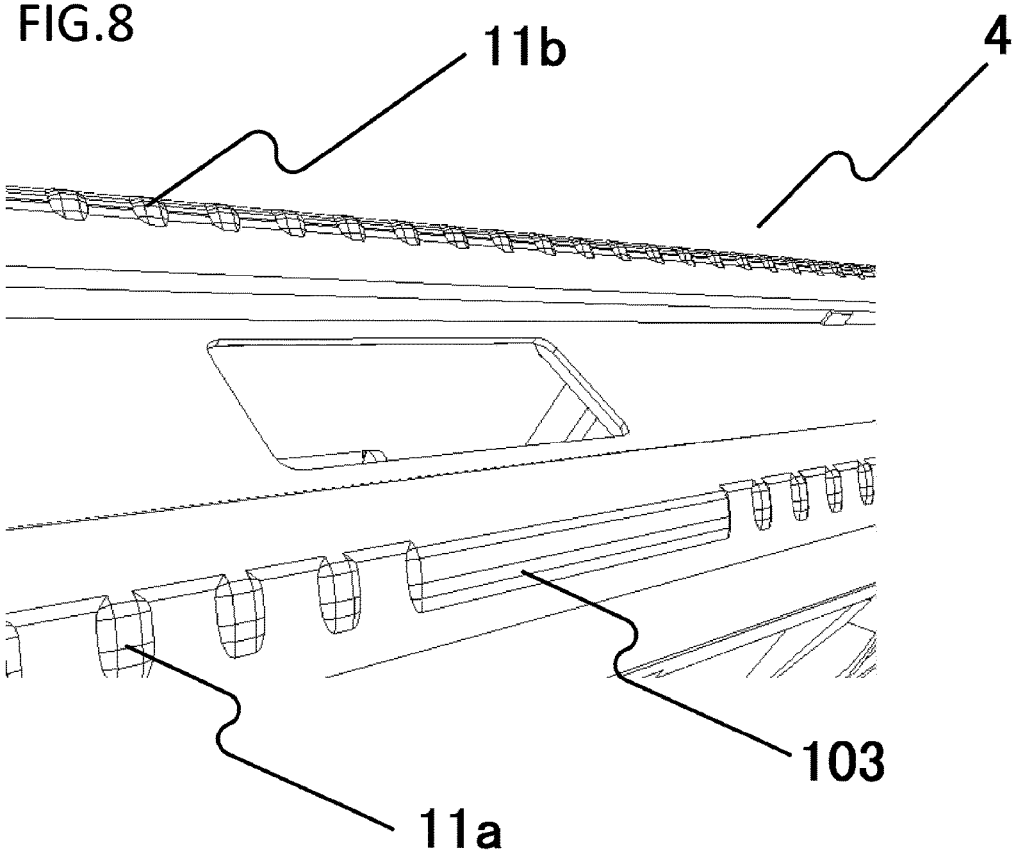
FIG. 8 is an enlarged view of grease regulating ribs according to a third embodiment of the invention.

According to the third embodiment, as a portion for regulating lubricant, a grease regulating rib 103 wider than the upstream rib 11*a* is formed in a range including a part of the heater holder 4 corresponding to the position of the temperature detecting element 8 in the longitudinal direction. FIG. 8 is a perspective view of the heater holder 4 and the grease regulating rib 103. The grease regulating rib 103 includes a prescribed number of adjacent connected ribs, in other words, is equivalent to the upstream ribs 11*a* removed of the gaps inbetween. Note that in the longitudinal direction of the heater holder 4, the percentage of the ribs per unit length of the region (a first region) of the curved surface 42*b* that overlaps the temperature detecting element 8 may be higher than the percentage of the region (a second region) of the curved surface 42*b* that does not overlap the temperature detecting element 8. The protrusion height t of the grease regulating rib 103 is equal to the height of the upstream rib 11*a* and preferably about 0.2 mm. The regulating width W2 of the grease regulating rib 103 in the longitudinal direction is preferably about in the range from 5 mm to 100 mm. The lubricating grease 9 circulates between the ribs in the area of the upstream ribs 11*a* and the downstream ribs 11*b*, and since the width of the rib is as short as 1 mm, the lubricating grease 9 is nipped and spread to be present uniformly on the surface of the heater 2. In the meantime, since the grease regulating rib 103 has a large width, the amount of the lubricating grease 9 returning to the temperature detecting element 8 is regulated.

Function of Third Embodiment

Now, the function of the third embodiment will be described.

The lubricating grease 9 on the sliding surface of the heater 2 sticks to the inner surface of the fixing film 1 as the fixing film 1 rotates, is let out from the downstream end of the sliding surface of the heater 2, and returns to the sliding surface of the heater 2 from the upstream end of the heater 2 as the fixing film 1 further rotates.

According to the third embodiment, when the fixing film 1 makes a rotation, the grease regulating rib 103 in a shape produced by connecting a prescribed number of upstream ribs 11*a* at the heater holder 4 and the inner surface of the fixing film 1 rub hard against each other, and the lubricating grease 9 at the inner surface of the fixing film is scraped off. In this way, the returning of the lubricating grease 9 to the heater 2 is regulated, and the lubricating grease 9 in the position corresponding to the position of the temperature detecting element 8 is reduced as compared to in the other position. When the amount of the lubricating grease 9 on the heater surface is small, heat from the heater 2 is transmitted to the fixing film 1, so that the heater 2 can be more easily provided with electric power. In this way, fixing failures can be reduced.

In the meantime, the upstream ribs 11*a* and the downstream ribs 11*b* for the heater 2 are provided, and higher lubricity than those in the first and second embodiments is provided accordingly.

Evaluation Tests

Then, the grease regulating rib 103 according to the third embodiment was subjected to evaluation tests about the fixability immediately after assembling and slipping after having endured passing of paper sheets for different regulating widths W similarly to the first embodiment.

In the evaluation tests, test examples of the grease regulating rib 103 according to the third embodiment with five regulating widths and comparative example 3 provided only with the upstream ribs 11*a* and the downstream ribs 11*b* and without the grease regulating rib 103 according to the third embodiment were compared. In the test examples, the five regulating widths are 3 mm (test example 11), 5 mm (test example 12), 10 mm (test example 13), 100 mm (test example 14), and 150 mm (test example 15).

The fixability and slipping evaluation after having endured passing of paper sheets were evaluated by the same method as that according to the first embodiment. The result is given in Table 3.

TABLE 3

| | Grease regulating width | Integral electric energy after passing 100 sheets | Fixability | Slipping |
|---|---|---|---|---|
| Test example 11 | 3 mm | 24.0 Wh | x | ○ |
| Test example 12 | 5 mm | 25.0 Wh | ○ | ○ |
| Test example 13 | 10 mm | 25.3 Wh | ○ | ○ |
| Test example 14 | 100 mm | 25.6 Wh | ○ | ○ |

TABLE 3-continued

| | Grease regulating width | Integral electric energy after passing 100 sheets | Fixability | Slipping |
|---|---|---|---|---|
| Test example 15 | 150 mm | 26.0 Wh | ○ | x |
| Comparative example 3 | No regulation | 23.5 Wh | x | ○ |

As in Table 3, in comparative example 3, the integral electric energy provided to the heater 2 was small, and the fixability was not good. In particular, the presence of the upstream ribs 11*a* and the downstream ribs 11*b* for the heater 2 increased the amount of the lubricating grease 9 and the integral electric energy itself was lower than that in comparative example 1. In the meantime, in the test examples according to the third embodiment, the grease regulating rib 103 was able to regulate the lubricating grease 9 in the position of the temperature detecting element 8, so that the integral electric energy was greater than that in comparative example 3 with no such regulation.

In test example 11, the slipping was evaluated OK while the fixability was not good. This is because the width of grease regulating rib 103 was small, the lubricating grease 9 came around from the periphery of the grease regulating rib 103, and the grease could not be regulated sufficiently.

In the test examples 12 to 14, both the fixability and slipping were both evaluated OK.

In these test examples, the grease regulating rib 103 was able to regulate the lubricating grease 9 in the position corresponding to the position of the temperature detecting element 8, so that the integral electric energy was large and the fixability was OK. The slipping as a negative effect by regulating the lubricating grease 9 was also evaluated OK according to the embodiment.

This is because the lubricating grease 9 was regulated only in the periphery of the position of the temperature detecting element 8, and therefore the effect on the slidability of the fixing film 1 was small.

In the meantime, in test example 15, the fixability was evaluated OK but the slipping evaluation was not good. This is because the width of the grease regulating rib 103 is so wide that the region for scraping off the lubricating grease 9 on the inner surface of the fixing film 1 was wide, and the slidability of the fixing film 1 was lowered.

In the configuration according to the third embodiment, for the width of the grease regulating rib 103 from 5 mm to 100 mm, the fixability and slipping evaluation were satisfactory.

However, the optimum value for the width of the grease regulating rib 103 varies depending on the fixation configuration, and the range from 5 mm to 100 mm does not always provide a satisfactory result. The regulating width is set so that the lubricating grease 9 in the position of the temperature detecting element 8 can be regulated depending on the fixation configuration and the slidability of the fixing film 1 can be secured.

As described above, when a large amount of lubricating grease 9 is on the heater 2 for example immediately after assembling, and the heater holder 4 has a large number of lubricating ribs 11, fixing failures can be reduced by providing the grease regulating rib 103 on the upstream side and regulating the lubricating grease 9 at the temperature detecting element 8.

Note that according to the third embodiment, the grease regulating rib 103 is provided at the upstream guide portion 42 of the heater holder 4, but the rib may be provided at the downstream guide portion 43 similarly to the protrusion for regulating grease 102 according to the second embodiment. The rib provided at the downstream guide portion 43 can regulate the returning of the lubricating grease 9 sticking to the inner circumferential surface of the fixing film 1 to the position of the sliding surface of the heater 2 corresponding to the position of the temperature detecting element 8, and the same effect can be provided. In addition, the grease regulating rib 103 may be provided at both of the upstream guide portion 42 and the downstream guide portion 43, in other words, the rib needs only be provided on at least one of the upstream side and the downstream side of the heater 2.

Other Embodiments

Figure 5A:
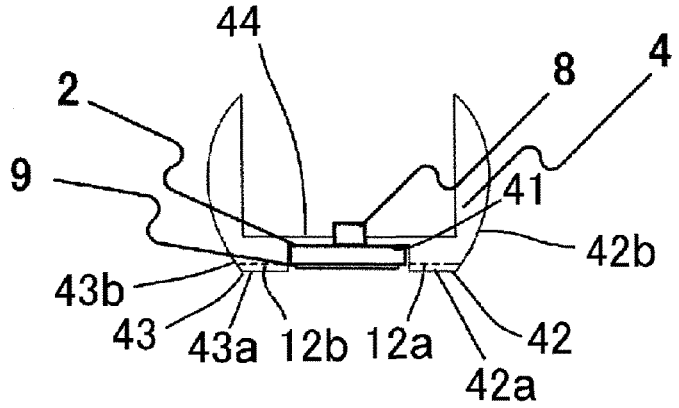
FIGS. 5A to 5C are views illustrating heater holders and a heater for a fixing apparatus according to other embodiments of the invention.

FIG. 5A is a view of a main part of a fixing apparatus according to another embodiment of the invention.

According to the embodiment, a plurality of lubricating slits (grooves) 12 are provided as lubricating grooves in place of the ribs according to the third embodiment, so that lubrication by the lubricating grease 9 is allowed. More specifically, the upstream guide portion 42 and the downstream guide portion 43 of the heater holder 4 are provided with a plurality of upstream slits 12*a* and downstream slits 12*b* as lubricating grooves extending in the rotation direction of the fixing film 1 at prescribed intervals in the direction of the rotation axis. In the illustrated example, the upstream slits 12*a* and the downstream slits 12*b* are provided at the flat surfaces 42*a* and 43*a* of the upstream guide portion 42 and the downstream guide portion 43, respectively.

Figure 5B:
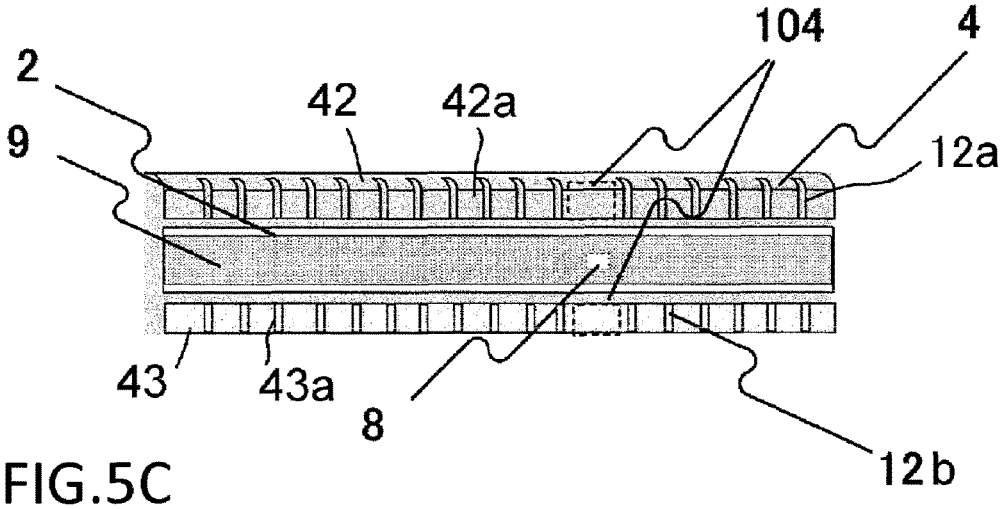

According to the embodiment, a grease regulating portion 104 is provided as a portion without a slit or groove in the position corresponding to the position of the temperature detecting element 8 to the upstream slits 12*a* and the downstream slits 12*b* in FIG. 5(B). Note that the percentage of the lubricating slits per unit length of the region (a first region) of the flat surface 42*a* that overlaps the temperature detecting element 8 in the longitudinal direction of the heater holder 4 may be lower than that of the region (a second region) of the flat surface 42*a* that does not overlap the temperature detecting element 8.

Figure 5C:
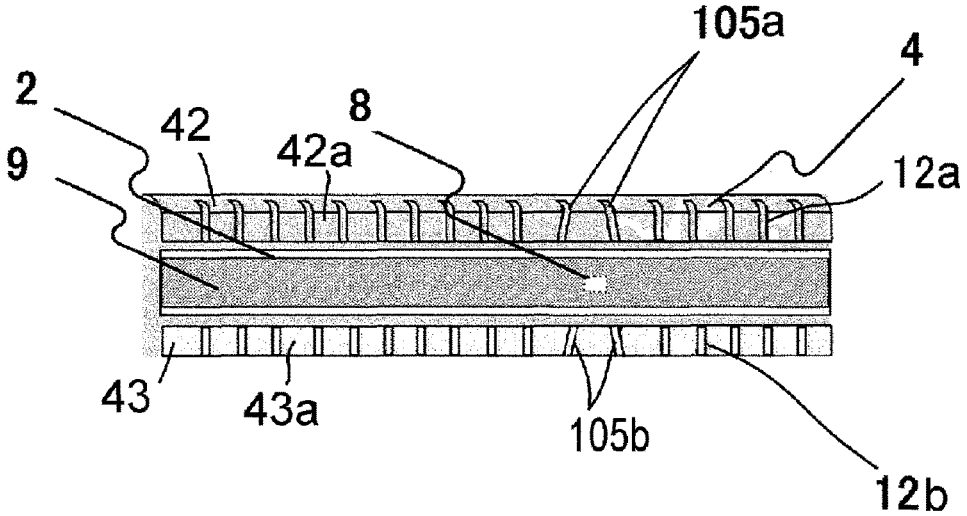

In the example illustrated in FIG. 5(C), among the upstream slits 12*a* and the downstream slits 12*b*, inclined slits 105*a* and 105*b* are provided as inclined grooves that guide the lubricating grease 9 in a direction away from the position corresponding to the position of the temperature detecting element 8 in the direction of the rotation axis. A pair of upstream inclined slits 105*a* is provided to sandwich the temperature detecting element 8 therebetween from the axial direction and inclined so that the distance therebetween increases with respect to the temperature detecting element 8 to the downward side in the rotation direction. The inclined slits 105*a* guide the lubricating grease 9 in a spreading direction toward the temperature detecting element 8, and the amount of grease in the position corresponding to the position of the temperature detecting element 8 is reduced.

A pair of inclined slits 105*b* is also provided to sandwich the portion corresponding to the temperature detecting element 8 therebetween from the axial direction and inclined so that the distance therebetween increases with respect to the temperature detecting element 8 to the downward side in the rotation direction. The inclined slits 105*b* guide the lubricating grease 9 in a spreading direction toward the temperature detecting element 8, so that the amount of the grease sticking to the fixing film 1 to be let out is reduced in the position corresponding to the temperature detecting element 8 and the amount returning to the sliding surface after a rotation is also reduced.

In this way, when the plurality of lubricating slits 12 as lubricating grooves are provided, the amount of the lubricating grease returning to the position corresponding to the position of the temperature detecting element 8 can be regulated, so that the same effect as the third embodiment can be provided.

Note that while the grease regulating portions 104*a* and 104*b* and the inclined slits 105*a* and 105*b* are provided both on the upstream side and the downstream side with respect to the heater 2, these portions and slits may be provided only on one of the upstream side and the downstream side. Stated differently, they may be provided on at least one of the upstream side and the downstream side.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-017446, filed Feb. 1, 2016, which is hereby incorporated by reference herein in its entirety.

What is claimed is:

1. A fixing apparatus fixing a toner image on a recording material, the fixing apparatus comprising:

a tubular film;

an elongate heater having a first surface and a second surface, which is on an opposite side to the first surface, the first surface of the heater being in contact with an inner surface of the tubular film;

a roller provided in contact with an outer surface of the tubular film to form a nip portion between the tubular film and the roller, where in the recording material having the toner formed theron is heated and has the image fixed theron while being transported by the nip portion;

a lubricant interposed between the first surface of the heater and the inner surface of the tubular film;

a temperature detecting member provided on the second surface of the heater to detect a temperature of the heater;

a controller controlling electrical power to be supplied to the heater so that a temperature detected by the temperature detecting member reaches a target temperature; and a guide member for guiding the tubular film, wherein the guide member is elongated in a longitudinal direction of the heater and is in contact with the inner surface of the tubular film, the guide member having a protrusion protruding toward the inner surface of the tubular film, and the guide member has a first region and a second region in the longitudinal direction, the first region being a region that overlaps the temperature detecting member as seen in a direction that is perpendicular to the longitudinal direction of the guide member, and the second region being a region that does not overlap the temperature detecting member as seen in the direction that is perpendicular to the longitudinal direction of the guide member, and wherein the protrusion overlaps the first region of the guide member as seen in the direction that is perpendicular to the longitudinal direction.

2. The fixing apparatus according to claim 1, wherein the guide member has a support that supports the second surface of the heater.

3. A fixing apparatus fixing a toner image on a recording material, the fixing apparatus comprising:

a tubular film;

an elongate heater having a first surface and a second surface, which is a surface on an opposite side to the first surface, the first surface of the heater being in contact with an inner surface of the tubular film;

a roller provided in contact with an outer surface of the tubular film to form a nip portion between the tubular film and the roller, where in the recording material having the toner formed thereon is heated and has the image fixed theron while being transported by the nip portion;

a lubricant interposed between the first surface of the heater and the inner surface of the tubular film;

a temperature detecting member provided on the second surface of the heater to detect a temperature of the heater;

a controller controlling electrical power to be supplied to the heater so that a temperature detected by the temperature detecting member reaches a target temperature; and a guide member for guiding the tubular film, wherein the guide member is elongated in a longitudinal direction of the heater and is in contact with the inner surface of the tubular film, the guide member having a plurality of grooves provided side by side in a longitudinal direction of the guide member at intervals at a guide surface opposed to the inner surface of the tubular film, and a first region of a guide surface of the guide member having a lower percentage of the grooves per unit length in the longitudinal direction of the guide member than that of a second region of the guide surface, and the first and second regions being a region of the guide surface that overlaps the temperature detecting member and a region of the guide surface that does not overlap the temperature detecting member, respectively, as seen in a direction that is perpendicular to the longitudinal direction of the guide member.

4. A fixing apparatus fixing a toner image on a recording material, the fixing apparatus comprising:

a tubular film;

an elongate heater having a first surface and a second surface, which is a surface on an opposite side to the first surface, the first surface of the heater being in contact with an inner surface of the tubular film;

a roller provided in contact with an outer surface of the tubular film to form a nip portion between the tubular film and the roller, where in the recording material having the toner formed thereon is heated and has the image fixed thereon while being transported by the nip portion;

a lubricant interposed between the first surface of the heater and the inner surface of the tubular film;

a temperature detecting member provided on the second surface of the heater to detect a temperature of the heater;

a controller controlling electrical power to be supplied to the heater so that a temperature detected by the temperature detecting member reaches a target temperature; and a guide member for guiding the tubular film, wherein the guide member is elongated in a longitudinal direction of the heater and is in contact with the inner surface of the tubular film, and a first region of a guide surface of the guide member that overlaps the temperature detecting member as seen in a direction that is perpendicular to a longitudinal direction of the guide member being configured to allow the lubricant sticking to the inner surface of the tubular film to be more easily scraped off than a second region of the guide surface of the guide member that does not overlap the temperature detecting member.

5. The fixing apparatus according to claim 3, wherein the guide member is configured to have greater contact pressure, exerted in contact with the inner surface of the tubular film, in the first region than in the second region of the guide member.

6. The fixing apparatus according to claim 1, wherein the protrusion comprises a first protrusion, and the guide member further has a second protrusion that does not overlap the first region of the guide member as seen in the direction that is perpendicular to the longitudinal direction, and a width of the first protrusion being longer than a width of the second protrusion in the longitudinal direction.

7. The fixing apparatus according to claim 1, wherein one end of the protrusion is nearer to one end of the guide member than one end of the temperature detecting member in the longitudinal direction.

8. The fixing apparatus according to claim 7, wherein the other end of the protrusion is nearer to the other end of the guide member than the other end of the temperature detecting member in the longitudinal direction.

9. The fixing apparatus according to claim 1, wherein the protrusion prevents the lubricant from moving to the temperature detecting member.

10. A fixing apparatus fixing a toner image on a recording material, the fixing apparatus comprising:

a tubular film;

an elongate heater having a first surface and a second surface which is on an opposite side to the first surface, the first surface of the heater being in contact with an inner surface of the tubular film;

a roller provided in contact with an outer surface of the tubular film to form a nip portion between the tubular film and the roller, where in the recording material having the toner formed thereon is heated and has the image fixed thereon while being transported by the nip portion;

a lubricant interposed between the first surface of the heater and the inner surface of the tubular film;

a temperature detecting member provided on the second surface of the heater to detect a temperature of the heater;

a controller controlling electrical power to be supplied to the heater so that a temperature detected by the temperature detecting member reaches a target temperature; and a guide member for guiding the tubular film, wherein the guide member is elongated in a longitudinal direction of the heater and is in contact with the inner surface of the tubular film, the guide member having a plurality of protrusions provided side by side in a longitudinal direction of the guide member at intervals at a guide surface opposed to the inner surface of the tubular film and being in contact with the inner surface of the tubular film, and a first region of the guide surface of the guide member is fully occupied with one of the protrusions and a second region of the guide surface of the guide member includes a protrusion surface and a non-protrusion surface, and the first region is a region of the guide surface that overlaps the temperature detecting member as seen in a direction that is perpendicular to the longitudinal direction of the guide member, and the second region is a region of the guide surface that does not overlap the temperature detecting member as seen in the direction that is perpendicular to the longitudinal direction of the guide member.

11. The fixing apparatus according to claim 10, wherein the guide member has a support that supports the second surface of the heater.

12. The fixing apparatus according to claim 10, wherein the protrusions protrude toward the inner surface of the tubular film.

13. The fixing apparatus according to claim 10, wherein the first and second regions are on an upstream side of the heater.

14. The fixing apparatus according to claim 10, wherein, in the first region, one of the protrusions is provided without any adjacent spaces, and, in the second region, at least one of the protrusions is provided along with at least one space adjacent to the at least one protrusion.

* * * * *